US008150667B2

(12) United States Patent
Ledgerwood, III

(10) Patent No.: US 8,150,667 B2
(45) Date of Patent: Apr. 3, 2012

(54) DISCRETE ELEMENT MODELING OF ROCK DESTRUCTION UNDER HIGH PRESSURE CONDITIONS

(75) Inventor: Leroy W. Ledgerwood, III, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 716 days.

(21) Appl. No.: 11/946,973

(22) Filed: Nov. 29, 2007

(65) Prior Publication Data

US 2009/0132218 A1 May 21, 2009

Related U.S. Application Data

(60) Provisional application No. 60/872,057, filed on Nov. 29, 2006.

(51) Int. Cl.
*G06G 7/48* (2006.01)

(52) U.S. Cl. ..... 703/7

(58) Field of Classification Search ..... 703/7
See application file for complete search history.

(56) References Cited

OTHER PUBLICATIONS

Bobo, R.A., et al., Keys to Successful Competitive Drilling, Part 5B, World Oil, Oct. 1957, pp. 185-188.
Bredthauer, R.O., Strength Characteristics of Rock Samples Under Hydrostatic Pressure, Rice University Master's Thesis, Apr. 1955.
Caicedo, H., et al., SPE 92576, Unique ROP Predictor Using Bit specific Coefficient of Sliding Friction and Mechanical Efficiency as a Function of Confined Compressive Strength, presented at the SPE/IADC Drilling Conference, Amsterdam, The Netherlands, Feb. 23-25, 2005, pp. 1-19.
Cunningham, R.A., An Empirical Approach for Relating Drilling Parameters, Journal of Petroleum Technology, Jul. 1978, pp. 987-991.
Cunningham, R.A., et al., Laboratory Study of the Effects of Overburden, Formation and Mud Column Pressures on Drilling Rates of Permeable Formations, Petroleum Transactions, AIME, vol. 216, (Presented at the 33rd Annual Fall Meeting of the Society of Petroleum Engineers, Houston, 1958), pp. 9-17, 1959.
Cunningham, R.A., The Effect of Hydrostatic Stress on the Drilling Rates of Rock Formations, Rice University Master's Thesis, Apr. 1955, 55 pages.
Curry, D.A., et al., Technical Limit Specific Energy—An Index to Facilitate Drilling Performance Evaluation, presented at the SPE/IADC Drilling Conference, Amsterdam, 2005, SPE/IADC 92318, pp. 1-8.
Detournay, E., et al., Dependence of Drilling Specific Energy on Bottom Hole Pressure in Shales, SPE/ISRM 78221, presented at the SPE/ISRM Rock Mechanics, Irving, Texas, 2002, pp. 1-10.
Detournay, E., et al., Plastic flow regimes for a tool cutting a cohesive frictional material, in Pande & Pietrusczak (eds) Numerical Models in Geomechanics, pp. 367-374, Rotterdam: Balkema, 1992.
Dupriest, F.E, Maximizing Drill Rates with Real Time Surveillance of Mechanical Specific Energy, SPE 92194, presented at the SPE/IADC Conference, Amsterdam, 2005, pp. 1-10.
Garnier, A.J., et al., Phenomena Affecting Drilling Rates at Depth, Petroleum Transactions, AIME, vol. 216, 1959, pp. 232-239.

(Continued)

*Primary Examiner* — Hugh Jones
(74) *Attorney, Agent, or Firm* — TraskBritt

(57) ABSTRACT

Discrete Element Modeling (DEM) of rock subject to high confining pressures, such as in a subterranean drilling environment, may be used to predict performance of cutting structures used in drill bits and other drilling tools, as well as of the tools themselves. DEM may also be used to create "virtual" rock exhibiting specific drillability characteristics with or without specific reference to any actual rock, for purposes of assessing cutting efficiency of various cutting structure configurations and orientations, as well as of drilling tools incorporating same.

14 Claims, 6 Drawing Sheets

OTHER PUBLICATIONS

Gerbaud, L., et al., PDC Bits: All Comes from the Cutter Rock Interaction, IADC/SPE 98988, presented at the IADC/SPE Drilling Conference, Miami, 2006, pp. 1-9.
Huang, H., Discrete Element Modeling of Tool Rock Interaction, University of Minnesota Ph.D Thesis, Dec. 1999, 149 pages.
Kaitkay, P.V., Modeling of Rock Cutting Using Distinct Element Methods, Kansas State University Master's Thesis, 2002, 156 pages.
Kolle, J.J., Dynamic Confinement Effects on Fixed Cutter Drilling, Final Report, Gas Research Institute, Jul. 1995, 57 pages.
Kühne, I.G., The Mode of Operation of Rotary Bits and Other Rotary Rock Drills (Die Wirkungsweise von Rotarymeiseln and anderen drehenden Gesteinsbohrern, Sonderdruck aus der Zeitschrift), Bohrtecknik Brunnenbau, Nos. 1-5, 1952, 83 pages.
Pessier, R.C., et al., Quantifying Common Drilling Problems with Mechanical Specific Energy and a Bit Specific Coefficient of Sliding Friction, SPE 24584, presented at the 67th annual Technical Conference and Exhibition of the SPE, Washington, 1992, pp. 373-388.
Potyondy, D.O., et al., A bonded-particle model for rock, Int. J. Rock Mech. Min. Sci. 41(8), pp. 1329-1364, 2004.
Richard, T., Determination of Rock Strength from Cutting Tests, University of Minnesota Master's Thesis, Dec. 1999, 112 pages.
Simon, R., Energy Balance in Rock Drilling, SPE Journal, Dec. 1963, pp. 298-306, 1963.
Teale, R., The Concept of Specific Energy in Rock Drilling, Int. J. Rock Mech. Mining Sci., vol. 2, pp. 57-73, 1965.
Vajdova, V., et al., Compaction, dilatancy, and failure in porous carbonate rocks, Journal of Geophysical Research, vol. 109, 2004, pp. 1-16.
Van Lingen, N.H., Bottom Scavenging a Major Factor Governing Penetration Rates at Depth, Journal of Petroleum Tech., Feb. 1962, pp. 187-196.
Warren, T.M., et al., Laboratory Drilling Performance of PDC Bits, SPE Drilling Engineering, Jun. 1988, pp. 125-135.
Winters, W.J., et al., Roller Bit Model With Rock Ductility and Cone Offset, SPE 16696, presented at the 62nd Annual Technical Conference and Exhibition Dallas, 1987, pp. 421-432.
Wong, T.F., et al., Mechanical Compaction of Porous Sandstone, Oil and Gas Science and Technology, vol. 54, No. 6, pp. 715-727, 1999.
Lei et al., Distinct Element Modeling of Rock Cutting under Hydrostatic Pressure, Key Engineering Materials, vol. 250 (2003), pp. 110-117.
Kaitkay et al., Experimental Study of Rock Cutting Under External Hydrostatic Pressure, Journal of Materials Processing Technology, vol. 159 (2005), pp. 206-213.
International Search Report for International Application No. PCT/US2007/024596, mailed Dec. 8, 2010, 2 pages.
International Written Opinion for International Application No. PCT/US2007/024596, mailed Dec. 8, 2010, 11 pages.
"PFC2D, Particle Flow Code in 2 Dimensions, User's Guide," Itasca Consulting Group, Inc., Minneapolis, MN (1999) 4 pages.
"PFC2D, Particle Flow Code in 2 Dimensions, FISH in PFC," Itasca Consulting Group, Inc., Minneapolis, MN (1999) 33 pages.
Potyondy et al., "A bonded-particle model for rock," International Journal of Rock Mechanics & Mining Sciences 41 (2004) 1329-1364.

DISCRETE ELEMENT MODELING OF ROCK DESTRUCTION UNDER HIGH PRESSURE CONDITIONS

CROSS-REFERENCE TO RELATED APPLICATIONS

This application claims the benefit of U.S. Provisional Patent Application Ser. No. 60/872,057, filed on Nov. 29, 2006 and entitled DISCRETE ELEMENT MODELING OF ROCK CUTTING UNDER HIGH PRESSURE CONDITIONS, the disclosure of which application is hereby incorporated herein in its entirety by this reference.

TECHNICAL FIELD

The present invention, in various embodiments, relates to discrete element modeling (DEM) of cutting or otherwise destroying subterranean rock under high pressure conditions, and employing such modeling to improve cutting efficiency of cutters, drill bits and other tools for removing subterranean rock in the context of, by way of nonlimiting example only, drilling or reaming a subterranean borehole.

BACKGROUND

During the early part of the twentieth century, the drilling community did not account for the strengthening effect of downhole pressure on rock. I. G. Kühne, 1952, Die Wirkungsweise von Rotarymeiseln and anderen drehenden Gesteinsbohrern, Sonderdruck aus der Zeitschrift, Bohrtecknik-Brunnenbau, Helf 1-5, pointed out the effect of pressure and suggested that rock may be treated as a Mohr-Coulomb material. Research conducted at Rice University explored the ramifications of Kühne's proposal. R. O. Bredthauer, *Strength Characteristics of Rock Samples Under Hydrostatic Pressure*, Rice University Master's Thesis; R. A. Cunningham, *The Effect of Hydrostatic Stress on the Drilling Rates of Rock Formations,* 1955, Rice University Master's Thesis; E. M. Galle, 1959, *Photoelastic Analysis of the Stress Near the Bottom of a Cylindrical Cavity Due to Non-Symmetrical Loading*, Rice University Master's Thesis. Similar research spread rapidly through the industry.

This early research showed that the most important factor governing drillability downhole is the differential pressure, defined as the difference between the pressure of the mud in the borehole (borehole pressure) and the pressure in the pores of the rock (pore pressure). Differential pressure defines an effective stress confining the rock matrix and is much more important as an indicator of rock drillability than the tectonic stresses. These early researchers adopted a Mohr-Coulomb model in which differential pressure defines the hydrostatic component of stress. The drilling community still uses the parameters of a Mohr-Coulomb model, namely Unconfined Compressive Strength (UCS) and Friction Angle (N) to characterize rock. However, rates of penetration based on these models under-predict the effect of pressure on drilling, which suggests that there must be other rock properties that govern drilling under pressure.

Drilling data, reported as early as Cunningham's thesis referenced above, showed that differential pressure had a more profound effect on the rate of penetration than would be expected by the increase in strength of a Mohr-Coulomb material. It has also been proposed that there are other mechanisms at work which they described as various forms of a phenomenon called "chip hold down." A. J. Garnier and N. H. Van Lingen, 1959, Phenomena Affecting Drilling Rates at Depth, Trans AIME 217; N. H. Van Lingen, 1961, Bottom Scavenging—A Major Factor Governing Penetration Rates at Depth, *Journal of Petroleum Tech*., Feb., pp. 187-196. Chip hold down refers to force that the drilling mud may exert on a cutting, or a bed of crushed material, due to differential pressure. The industry also recognized that permeability has a strong effect on differential pressure. R. A. Bobo and R. S. Hoch, 1957, Keys to Successful Competitive Drilling, Part 5b, *World Oil*, October, pp. 185-188. As a drill bit shears rock, the rock dilates, causing the pore volume to increase. If the rock is impermeable, this will cause a reduction of pore pressure, increasing differential pressure, strengthening the rock. More recent studies quantify these relationships. E. Detournay and C. P. Tan, 2002, Dependence of Drilling Specific Energy on Bottom-Hole Pressure in Shales, SPE/ISRM 78221, presented at the SPE/ISRM Rock Mechanics, Irving, Tex.; J. J. Kolle, 1995, Dynamic Confinement Effects on Fixed Cutter Drilling, Final Report, Gas Research Institute.

Complexities of the drilling process led some researchers to abandon confined strength measured in triaxial tests and define a "drilling strength" that can be determined empirically with a drill bit itself. R. A. Cunningham, 1978, An Empirical Approach for Relating Drilling Parameters, *Journal of Petroleum Technology*, July, pp. 987-991. While useful in predicting rates of penetration, such models give little insight into the physical process of rock destruction.

Another approach based on specific energy has also been used. R. Simon, 1963, Energy Balance in Rock Drilling, *SPE Journal*, December, pp. 298-306; R. Teale, 1964, The Concept of Specific Energy in Rock Drilling, *Int. J. Rock Mech. Mining Sci*. vol. 2, pp. 57-73. Specific energy is the energy required to remove a unit volume of rock and has the units $n/m^2$ (psi). When drilling rock efficiently at atmospheric pressure, the specific energy approaches a number numerically close to the UCS of the rock. This is useful as a measure of the drilling efficiency. A driller can measure the specific energy of a drilling process, compare that to the UCS, and quantity how efficient the drilling process is.

It has been suggested that the foregoing concept could be applied to drilling under pressure. R. C. Pessier and M. J. Fear, 1992, Quantifying Common Drilling Problems with Mechanical Specific Energy and a Bit-Specific Coefficient of Sliding Friction, SPE 24584, presented at the $67^{th}$ annual Technical Conference and Exhibition of the SPE, Washington. However, there remains the question of what strength should be used to define efficient drilling in the pressure environment. An obvious first guess might be that Confined Compressive Strength (CCS) defines the limit. However, the inventor herein has learned that plugging CCS determined by Mohr-Coulomb type relations into specific energy-based models of drilling under-predicts the increased difficulty of drilling at a given differential pressure. Recently, several papers have appeared exploiting specific energy methods in oil and gas drilling. F. E. Dupriest, 2005, Maximizing Drill Rates with Real-Time Surveillance of Mechanical Specific Energy, SPE 92194, presented at the SPE/IADC Conference. Amsterdam; H. Caicedo and B. Calhoun, 2005, SPE 92576, Unique ROP Predictor Using Bit-specific Coefficient of Sliding Friction and Mechanical Efficiency as a Function of Confined Compressive Strength, presented at the SPE/IADC Drilling Conference, Amsterdam; D. A. Curry and M. J. Fear, 2005, Technical Limit Specific Energy—An Index to Facilitate Drilling Performance Evaluation, presented at the SPE/IADC Drilling Conference, Amsterdam. Typically, these papers have laboratory-derived empirical relations defining a drilling strength, a number that is higher than the CCS.

In summary, the industry has realized for a long time that UCS and N are not sufficient to account for the increased difficulty of drilling with increasing hydrostatic pressure. However, these properties continue to be measured and quoted when describing rock.

Rates of penetration based on these models under-predict the effect of downhole pressure on drilling, which suggests that there must be other rock properties that govern drilling under pressure.

BRIEF SUMMARY OF THE INVENTION

Discrete Element Modeling (DEM) of rock cutting under high pressure conditions such as are experienced during subterranean drilling, indicates that mechanical properties of crushed rock detritus are more significant indicators of rock drillability than the mechanical properties of the original elastic rock. Specifically, the deformation and extrusion of crushed rock detritus consumes the bulk of the energy expended in rock destruction down hole. As used herein, the term "rock drillability" encompasses rock destruction under pressure by any mechanical means such as, by way of non-limiting example, a fixed cutter employed on a so-called "drag" bit, an insert or other tooth of a roller cone, and a percussion, or "hammer," bit. The term "bit" as used herein includes and encompasses any tool configured for removing rock of a subterranean formation.

These results suggest that some measure of the inelastic behavior of rock under pressure, such as the area under the stress/strain curve, which is a measure of specific energy, may be a more appropriate measure of rock drillability in high pressure environments. Characterizing rock in terms of the area under the stress/strain curve may enable more accurate ways to parameterize specific energy models of drilling and optimize design of cutting elements and drill bits for subterranean drilling.

In an embodiment of the invention. DEM modeling of rock is employed to predict behavior of "virtual" rock under high pressure conditions as subjected to cutting by a fixed cutter configured as a polycrystalline diamond compact (PDC) cutting element, as a thermally stable polycrystalline diamond cutting element, as a natural diamond cutting element, or as a superabrasive grit-impregnated cutting segment for various cutter configurations and orientations, including without limitation and where applicable, cutting face topography, cutting edge geometry, and cutting element back rake.

In further embodiments of the invention, DEM modeling of rock is employed to predict behavior of "virtual" rock under high pressure conditions as subjected to rock destruction by an insert or other tooth of a roller cone as employed in rolling cutter bits, as well by cutting structures of percussion bits. As used herein, the terms "cutting," and "cutter" or "cutting structure" refer, respectively, to destruction of subterranean rock and to cutting elements and other structures for effecting such destruction.

In another embodiment of the invention, DEM modeling may be employed to simulate selected rock characteristics to provide a virtual rock to assess cutting structure performance, with or without reference to any specific, actual rock formation. Aspects of this embodiment specifically encompass using a virtual rock created by DEM modeling to model rock destruction in a high pressure environment by any mechanical means.

In yet another embodiment of the invention, a virtual rock material is created by establishing an equivalence of stress/strain behavior of real rock material over a variety of above-ambient pressures when subjected to measured applied stresses and through measured, resulting rock strains in laboratory tests with the virtual stress/strain behavior of a virtual rock material as simulated by DEM over the same variety of pressures. Aspects of this embodiment encompass establishing such equivalence in both the elastic and the inelastic regions of the stress/strain curve, and over a wide enough range or set of confining pressures that both strain softening and strain hardening of the rock are captured.

In yet another embodiment of the invention, DEM modeling may be employed to predict performance of various drill bit designs, including without limitation drilling efficiency of such designs.

BRIEF DESCRIPTION OF THE DRAWINGS

FIG. 2*a* is a PFC model of rock cutting at atmospheric pressure using a fixed cutter at a 15° back rake while

DETAILED DESCRIPTION OF THE INVENTION

Discrete Element Modeling of Rock Cutting

Figure 1:
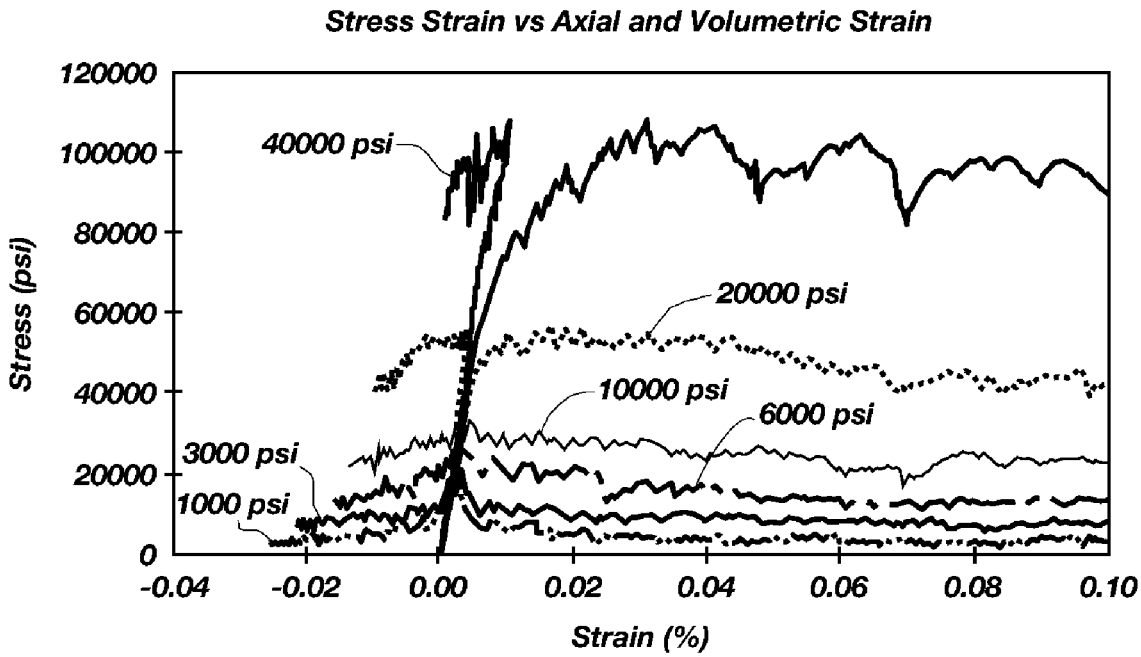
FIG. 1 is a graph of stress/strain curves generated using PFC (Particle Flow Code) for a rock simulated using PFC and FIGS. 1*a* and 1*b* are images of PFC triaxial specimens.

Discrete Element Modeling (DEM) materials are created by establishing an equivalence between the mechanical response of selected lab tests and DEM models of the same lab tests. D. O. Potyondy and P. A. Cundall, 2004, A bonded-particle model for rock, *Int. J. Rock Mech. Min. Sci.* 41(8), pp. 1329-1364. Success in the DEM method requires that appropriate lab tests and mechanical parameters be chosen to calibrate the DEM material. This, of course, presupposes that appropriate lab tests and mechanical parameters may be selected to characterize drilling under pressure. A common practice in the mining industry is to establish an equivalence in: density, elastic modulus, Poisson ratio, Brazilian strength, UCS and N. However, none of these equivalencies describe the inelastic response of the rock.

Rock cutting under pressure is very different from rock cutting at atmospheric conditions. At atmospheric conditions, a cutter drives long cracks into the rock, creating large chips of elastic rock. These chips usually fly away from the cutting face due to the release of elastic energy. Rock cutting under pressure in a drilling fluid, or "mud," environment does not create such chips. Instead, the cuttings generated are long "ribbons" of rock material that extrude up the face of the cutter and exhibit a saw-toothed shape. T. M. Warren and W.

K. Armagost, Laboratory Drilling Performance of PDC Bits, *SPE Drilling Engineering*, June 1988, pp. 125-135. However it has been discovered that such cuttings, contrary to previous speculations, are not composed of chips of elastic material bonded. More recent examination of cuttings shows that the cuttings typically consist of completely crushed and recompacted material. A. Judzis, R. G. Bland, D. A. Curry, A. D. Black, H. A. Robertson, M. J. Meiners, and T. Grant, 2007, Optimization of Deep Drilling Performance; Benchmark Testing Drives ROP Improvements for Bits and Drilling Fluids, SPE/IADC 105885, presented at the SPE/IADC Drilling Conference, Amsterdam. The crushed material is held together and, indeed, strengthened by the borehole pressure because drilling mud inhibits penetration of fluid into the crushed material.

One major challenge in modeling rock cutting with DEM is that of simulating the confining effect of drilling fluid under pressure on a cutting, as the surface of the cutting is not known *a priori*. Instead, a topological routine is employed that is run every $n^{th}$ time step, which examines the current state of the DEM specimen and identifies all "balls" simulating particles of formation material on the surface of the cutting and the cut surface of the formation. The routine then applies a force representing a hydrostatic pressure to the balls on these surfaces. This pressure boundary condition simulates an impermeable, real life filter cake of drilling fluid. As a result, the extreme condition of a very impermeable rock and cutting are modeled. Such an approach provides an upper bound as far as cutting forces are concerned. The other extreme, the atmospheric case, can be modeled easily, since the foregoing pressure boundary condition is not needed, and represents a lower bound as far as cutting forces are concerned.

Because a large amount of plastic deformation occurs in the above-described rock extrusion process the inventor has determined that the inelastic properties of rock are significant to drillability. It is also expected that strain softening or strain hardening will play a role. The conventional practice of looking at UCS and N to characterize rock does not capture any of this inelastic behavior.

The practice adopted in an embodiment of the present invention for calibrating DEM rock material is to match the stress/strain response of actual rock and the virtual DEM-simulated "rock" material, to high strain, and over a wide range of hydrostatic pressures. One DEM code which has been found to be particularly suitable for modeling according to an embodiment of the present invention is Particle Flow Code (PFC) produced by Itasca Consulting Company of Minneapolis, Minn. While the "FISH" functions that are commonly used to simulate triaxial tests in PFC do not allow deformation to large strain because the confining pressure is applied by "walls" which cannot deform as the lateral sides of the specimen deform, one embodiment of the present invention includes a new means of modeling triaxial tests in PFC by applying confining pressure with the same topological routines that apply pressure to the surface of a chip. While this disclosure describes DEM in the context of PFC, other discrete element modeling codes may be adapted to implement embodiments of the present invention. For example, another commercially available code, termed "EDEM" and produced by DEM Solutions of Edinburgh, Scotland, may be modified for use in simulating rock destruction under pressure. Accordingly, the terms "discrete element modeling" and "DEM" are nonlimiting in scope, and the use of Particle Flow Code as described herein is to be taken as only one representative example of how discrete element modeling may be used to implement embodiments of the present invention.

In triaxial tests, most rocks exhibit transition from shear localization at low confining pressures to shear-enhanced compaction at high confining pressures. V. Vajdova, P. Baud, and T. F. Wong, 2004, Compaction, dilatancy, and failure in porous carbonate rocks, *Journal of Geophysical Research*, Vol. 109; T. F. Wong and P. Baud, 1999, Mechanical Compaction of Porous Sandstone, *Oil and Gas Science and Technology*, Vol. 54, no. 6, pp. 715-727. In the shear localization mode, cracks coalesce along diagonal shear planes and, after this, large elastic wedges of material slide past each other, shearing the rubble on these shear planes. In the shear-enhanced compaction mode, most of the rock volume is failed.

Figure 1A:
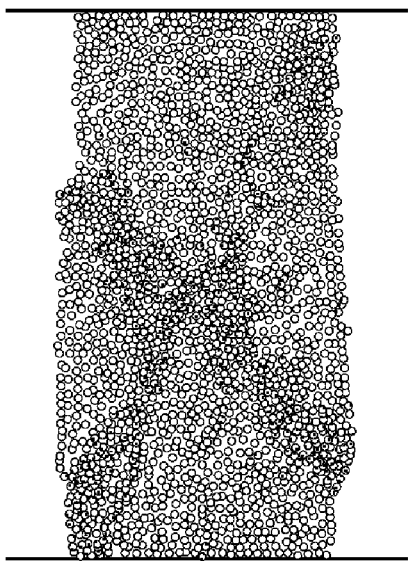
Figure 1B:
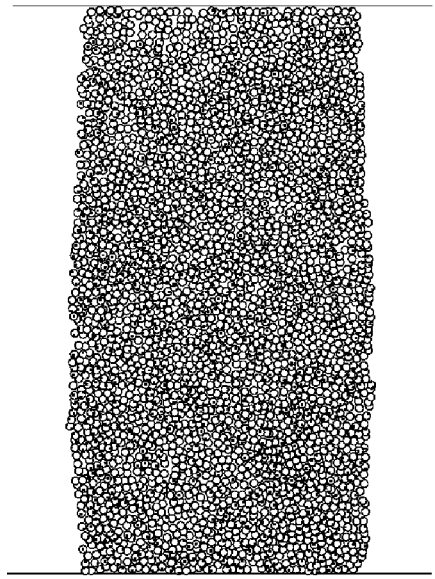

It was unknown whether PFC materials would exhibit this same transition from shear localization to shear-enhanced compaction. However, triaxial tests using DEM with several different PFC "virtual" rocks, over a wide range of porosity, have shown that a similar mechanism occurs. FIG. 1 shows PFC-generated stress/strain curves for a PFC rock. The curves to the right of the origin (0.00) are for axial strain and those to the left represent volumetric strain, with dilation being negative. Images of PFC triaxial specimens showing both strain localization and shear enhanced compaction under an applied load are designated as FIGS. 1*a* and 1*b*, respectively. The shaded, slightly darker particles (balls) on these figures represents cracks and balls that have broken all bonds with other balls (e.g., crushed material). The confining pressure was varied in the tests from atmospheric pressure to 275 MPa (40,000 psi). As used herein, the term "triaxial" as used with reference to tests in the DEM environment and to actual tests employed to establish equivalency of the two test formats (actual and DEM) using a cylindrical specimen placed between two load platens for application of an axial load are, in fact, bi-axial tests. However, the colloquial term "triaxial" to describe such a test in a physical environment is used by the industry and, thus, herein.

It is not common to conduct triaxial tests to such high strain in the oil and gas industry. Tests are usually terminated after the elastic limit or proportional limit is reached. It is also common to conduct only a few triaxial tests at confining pressures in the neighborhood of the in-situ pressure of interest. But FEA (finite element analysis) and DEM models both show that the hydrostatic component of stress in the rock ahead of an advancing cutter is much higher than the in-situ confining pressure. Also, the failure mechanism ahead of a cutter is more similar to shear-enhanced compaction than shear localization. Both of these observations suggest that the mechanical properties of rock should be simulated to pressures significantly higher than the in-situ pressure.

Figure 2A:
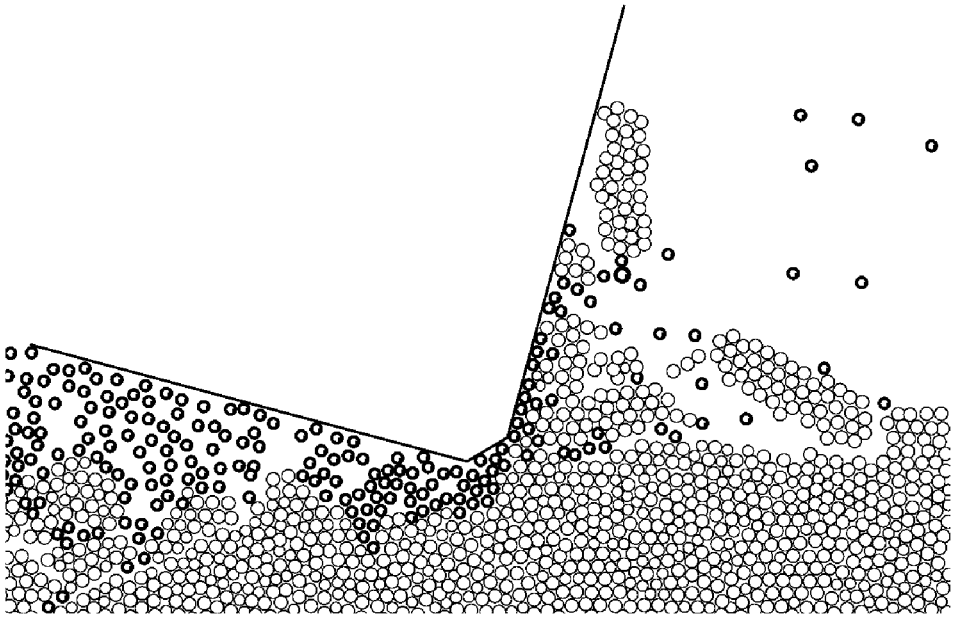
Figure 2B:
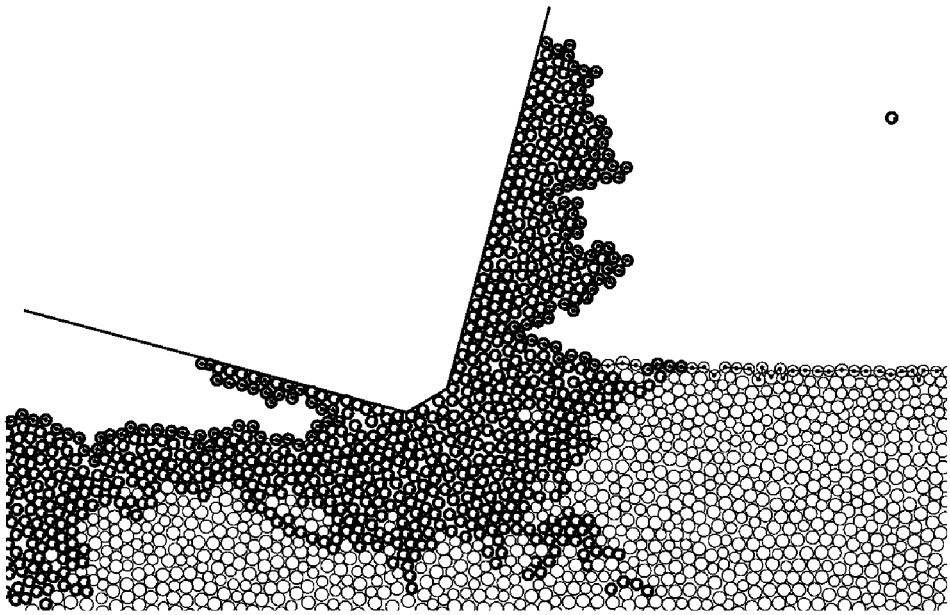
FIG. 2*b* is a PFC model of rock cutting at a high pressure of 20.7 MPa (3,000 psi) using a fixed cutter at a 15° back rake.

FIGS. 2*a* and 2*b* show PFC models of rock cutting at the two extremes of atmospheric and high pressure conditions. The cutter, as it would be mounted to a fixed cutter or "drag" bit or other earth-boring tool in practice, is shown in outline by a black line as back raked to 15° and exhibiting a 45° chamfer at the cutting edge proximate the formation being cut, and is moving from left to right. As shown in FIG. 2*b*, the balls having a dot in their centers and located at the outer surface of the compacted material against the cutting face and edge and along the side of the cutter, as well as against the formation itself, represent the boundary on which confining pressure is applied. Note that the mechanisms evident in these models are analogous to real life descriptions above. At atmospheric pressure large cracks are driven into the elastic rock matrix and large elastic chips fly off, as shown in FIG. 2*a*. In the high pressure case of FIG. 2*b*, the cutting is composed of completely crushed material, having a saw tooth shape and held together by pressure. As shown, the reconstituted cutting is extruding up the face of the cutter.

DEM Cutting Results

Quantitative agreement between cutting forces generated by PFC models and measured cutting forces is elusive because the PFC model employed is a two-dimensional model, (PFC2D) while actual rock cutting in the real world is, of course, effected in three dimensions. It has been shown that cutting in a groove has a significant effect on the cutting forces that cannot be accounted for using PFC2D. P. V. Kaitkay. 2002, *Modeling of Rock Cutting Using Distinct Element Methods*, Kansas State University Master's Thesis.

Figure 3:
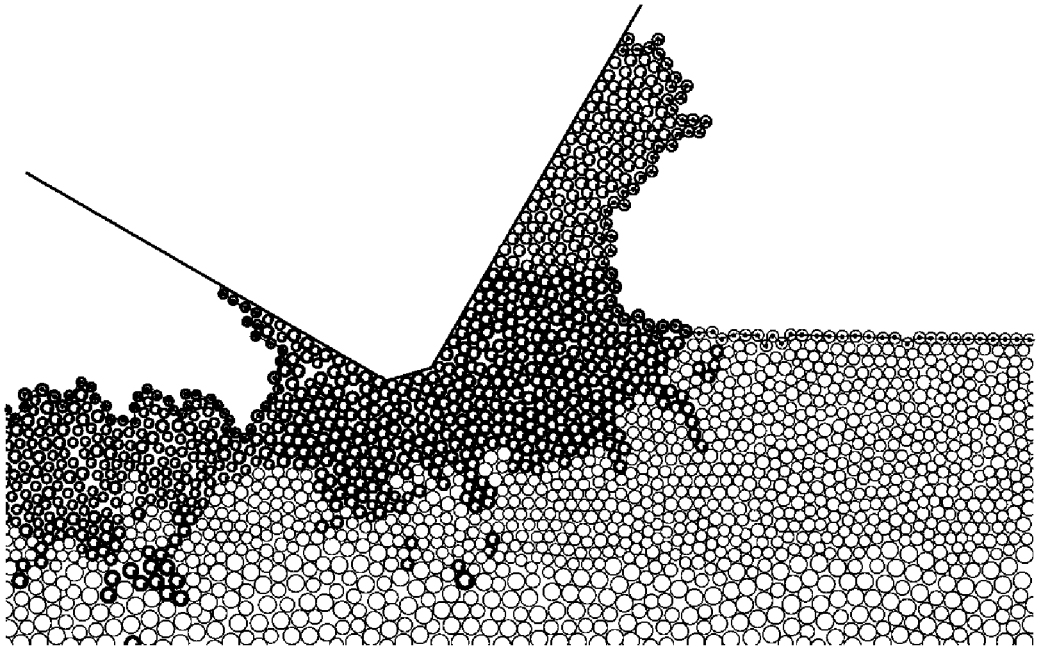
FIG. 3 is a PFC model of rock cutting at a high pressure of 20.7 MPa (3,000 psi) using a fixed cutter at a 30° back rake.

There is, however a wide range of qualitative agreement between rock cutting tests conducted at high pressure and PFC models. For example, cutting becomes less efficient with increasing back rake, just like in real cutting tests. FIG. 3 shows a 30° back rake cutter, modeled in the same manner and under the same simulated conditions as FIG. 2*b*, which shows a 15° back rake cutter. The 30° back rake case required 45% more normal force to maintain the same depth of cut, which is in accordance with actual rock cutting tests.

Another qualitative agreement between actual rock cutting tests and DEM modeling is that specific energy required to cut rock increases with decreasing depth of cut. That is, cutting becomes less efficient at lower depths of cut, just like it does in actual drilling. Whatever mechanisms govern this reduction in efficiency in real life are evidently reproduced in the model. Other qualitative agreements have also been observed to exist.

PFC indicates that one of the most significant mechanisms governing cutting efficiency is flow of the crushed formation material under the cutter. This mechanism is not widely recognized in the literature. Detournay and his students have observed and modeled this flow at atmospheric pressure. E. Detournay and A. Drescher, 1992, Plastic flow regimes for a tool cutting a cohesive-frictional material, in Pande & Pietrusczak eds., *Numerical Models in Geomechanics*, pp. 367-376, Rotterdam: Balkema; H. Huang, 1999, *Discrete Element Modeling of Tool-Rock Interaction*, University of Minnesota Ph.D Thesis; T. Richard, 1999, *Determination of Rock Strength from Cutting Tests*, University of Minnesota Master's Thesis. Gerbaud and his colleagues at the Ecole des Mines de Paris have performed lab tests that indicate some material must be flowing under the cutter. L. Gerbaud, S. Menand, and H. Sellami, 2006, PDC Bits: All Comes from the Cutter Rock Interaction, IADC/SPE 98988, presented at the IADC/SPE Drilling Conference, Miami. However, the effects Gerbaud predicts in empirical equations are not as profound as those indicated by PFC.

One significant fact that PFC models reveal is that the presence of a third material, the crushed rock, plays a key role in the cutting process. Cutters do not bear directly on the virgin elastic rock that we seek to excavate. Rather, there is always the presence of this third material between the cutter and the elastic rock. While publications have shown this third material in illustrations, the mechanical properties of the crushed material are almost always ignored in mathematical models of formation cutting, probably because it has been presumed that this crushed rock is rather weak. However, while the crushed material has no elastic strength, it has been determined by the inventor to have significant strength due to hydrostatic compression under the confining borehole pressure.

To be an effective tool in predicting cutter and drill bit performance, the constitutive properties of this crushed material must be determined. As the strength of a rock cutting is predominantly a function of differential pressure, the strength must be determined under pressure. Notably, as soon as the cutting is created, it begins imbibing filtrate from the drilling mud, which alters its strength. The strength, therefore, must be evaluated immediately after the cutting is created. One embodiment of the invention comprises a test to provide a first order approximation of the cutting strength.

Figure 4A:
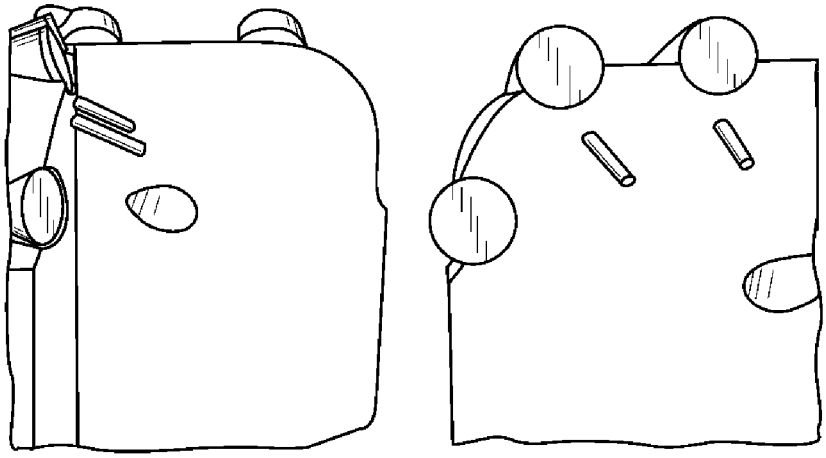
FIG. 4*a* includes line drawings taken from photographs of a test bit showing metal rods bent by formation material chips flowing on a blade of the bit from frontal and side perspectives.
Figure 4B:
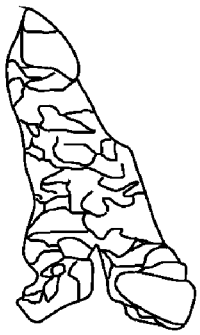
FIG. 4*b* is a line drawing taken from a photograph of a formation material chip bent by contact with one of the metal rods.

For calibration purposes, a special rotary drag bit using polycrystalline diamond compact (PDC) cutters was built, the cutters being spaced far enough apart that chips of formation material cut by the PDC cutters and flowing on each blade would not interact with each other. 3.17 mm (⅛ inch) diameter rods were mounted rotationally behind each PDC cutter, protruding from the blade, in the path of the cutting from a given cutter. Rods of different material, including copper, bronze and steel, were placed in the path of the cuttings to determine which rods the cuttings are able to bend and, thus, obtain an estimate of their strength. However, in tests with Catoosa shale at 41.4 MPa (6,000 psi) bottom hole pressure and drilling at 60 RPM with a depth of cut of 0.51 mm/rev (0.2 in/rev), the cuttings bent all the rods. A blade of the bit and bent rods is shown from frontal and side perspectives in FIG. 4*a*. A partially split cutting that was bearing against one of the rods is shown in FIG. 4*b*.

Knowing how much force is required to bend these rods, a lower bound of cutting strength was estimated, on the same order of magnitude as the original strength of the Catoosa shale.

Inelastic Rock Properties Govern Rock Cutting

Figure 5:
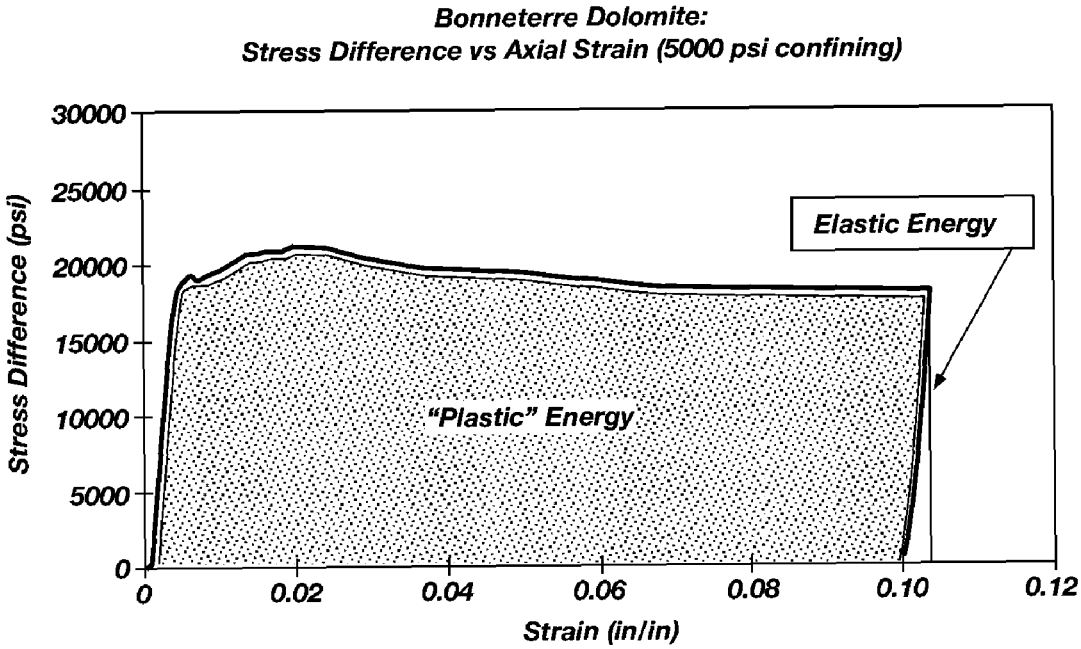
FIG. 5 is a graph of stress difference versus axial strain for Bonneterre Dolomite at 34.4 MPa (5,000 psi) confining pressure in an actual triaxial test.

PFC can show how much energy is partitioned in elastic strain in the balls, elastic strain in the bonds, friction between the balls, kinetic energy and damping. PFC indicates that during cutting under pressure, fifty times more energy is dissipated in friction (the sum of ball to ball and ball to wall friction) than is stored in elastic energy. This observation appears to be accurate because: (1) the crushed rock material is strong and large forces are required to deform it; (2) the volume of the crushed material being deformed at any instant is larger than the volume of the highly stressed elastic front ahead of the crushed rock; (3) the strain of the crushed rock is very high; (4) in a high strain elastic-plastic deformation, substantially more energy is dissipated in plastic deformation than elastic deformation. This last conclusion is illustrated in FIG. 5, which shows a stress/strain curve of Bonneterre Dolomite from an actual test. This stress/strain curve is from a triaxial test conducted at 41 MPa (6,000 psi) confining pressure strained to 10% strain. Even at this comparatively low strain, the plastic energy represents the large majority of the energy dissipation.

Figure 6:
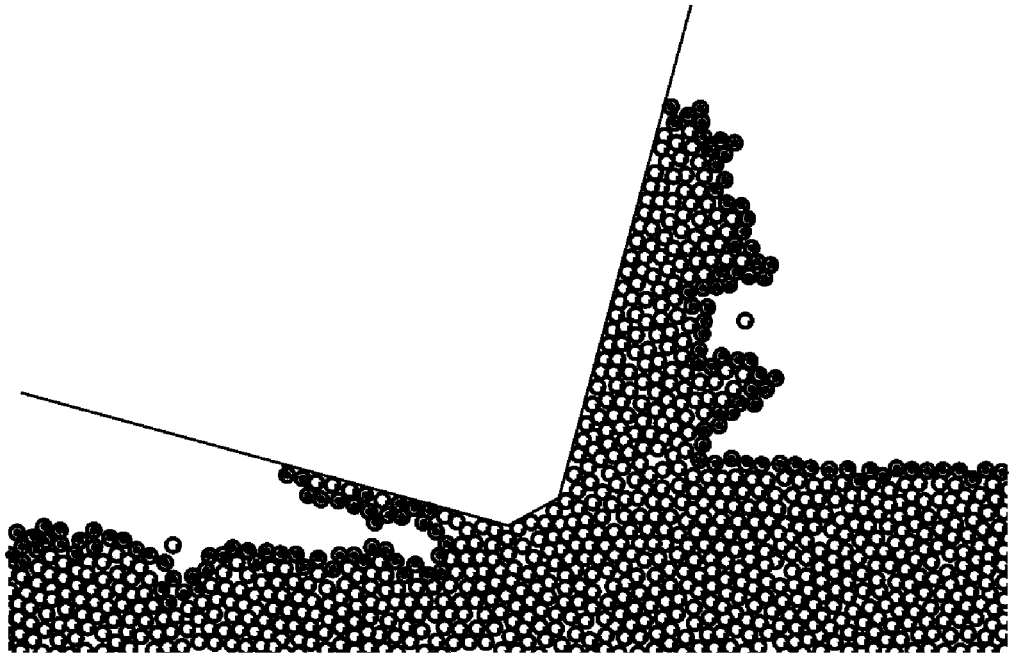
FIG. 6 is a PFC model of cutting unbonded formation material.

Since the majority of the energy expended in cutting under pressure is apparently dissipated in friction, then the elastic properties of the rock are largely immaterial. As an experiment, a PFC cutting test was run in a manner identical to that shown in FIG. 2*b*, but with all elastic ball-to-ball bonds deleted. The rock with bonds (shown in FIG. 2*b*) had a UCS of 55 MPa (8,000 psi). The rock with no bonds in the parallel test (shown in FIG. 6) was identical but had a cohesion of zero; this PFC material may be characterized to be like loose sand. Both of these PFC tests were conducted under a hydrostatic pressure of 20.7 MPa (3,000 psi) during cutting. The cutting forces required to cut the unbonded material of the parallel test were nearly identical to the cutting forces required to cut the bonded material. Real life experiments drilling on loose sand strengthened by borehole pressure have yielded similar results. R. A. Cunningham and J. G. Eenink, 1958, Laboratory Study of the Effects of Overburden, Formation and Mud Column Pressures on Drilling Rates of Permeable Formations, Presented at the 33$^{rd}$ Annual Fall Meeting of the Society of Petroleum Engineers, Houston.

In an embodiment of the invention, particular mechanical properties were selected for measurement in a triaxial test that would characterize this highly plastic process of rock cutting.

The area under the stress/strain curve is a measure of energy dissipated during deformation, and is also a measure of the specific energy. However, a particular strain level should be selected to quantify this area. Ideally, this area would be measured to the level of strain experienced by the rock during cutting. However, it is not possible to identify one strain level imposed on the rock during cutting because there is such a large variance in the strain field. It is possible, however, to define an "effective" strain during cutting for modeling purposes by extending the strain until the area under the stress/strain curve substantially equals the specific energy consumed in a real test. This approach seems to indicate that the effective strain is in the multiple hundreds of percent. Thus, if one were to compare the specific energy of two drag bits, differences in specific energy between them is related to differing amounts of strain imparted to the rock. More efficient bits are those which remove an equivalent volume of rock under the same conditions with less strain.

Winters and Warren proposed to measure the area under the stress/strain curve twenty years ago and Kolle reaffirmed this point. W. J. Winters and T. M. Warren, 1987, Roller Cone Bit Model with Rock Ductility and Cone Offset, SPE 16696, presented at the 62$^{nd}$ Annual Technical Conference and Exhibition Dallas. However, to the knowledge of the inventor this proposal has not been developed. Perhaps one reason is because implementation is more difficult than it sounds. As discussed above, it is presently unknown to what strain a triaxial test should be conducted and, if known, it would not be possible to conduct a triaxial test to such high strain. A much harder question, and one which is not susceptible to an accurate answer, is at what confining pressure for the crushed formation material should the area under the stress/strain curve be evaluated? As there is a wide variance in the hydrostatic component of stress in the stress field ahead of the cutter, it is likely that the differences in hydrostatic component of stress are great enough that some parts of the rock are strain softening and others are simultaneously strain hardening.

Another contemplated measure of rock drillability in a triaxial test might simply be the stress difference at high strain. The stress difference at high strain is a measure of the stress required to deform rock detritus. At very high strain, the stress difference tends to approach a steady value (like perfect plasticity). The area under the stress/strain curve at high strain approximates a long rectangle. Strain softening or strain hardening in the early part of the stress/strain curve has a negligible effect on the total area under a stress/strain curve measured to high strain. The height of the stress/strain curve, combined with an effective strain, defines the majority of the area.

Figure 7:
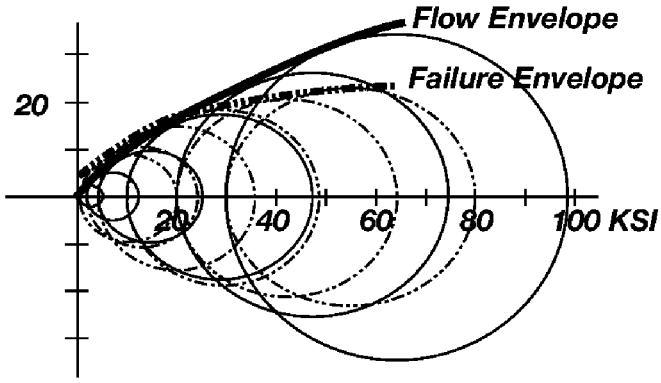
FIG. 7 is a Yield Surface and High Strain Flow Enveloped for Carthage Limestone.

Thus, it is contemplated to be constructive to create something like a "failure Envelope" of the stress difference required to deform detritus at high strain. FIG. 7 shows such an envelope, which may be termed a "flow envelope," superimposed over a yield surface, or failure envelope. These data were taken from triaxial tests conducted to 10% strain at confining pressures ranging from 3.4 MPa (500 psi) to 207 MPa (30,000 psi). The flow envelope in fact represents the position of the classical yield surface after strain softening and strain hardening have occurred. A measure of strength based on the flow envelope is believed to correlate better with actual drillability than confined compressive strength (CCS) of the rock, since the stress required to deform rock detritus goes up more rapidly with pressure than the stress to fail elastic rock.

Figure 8:
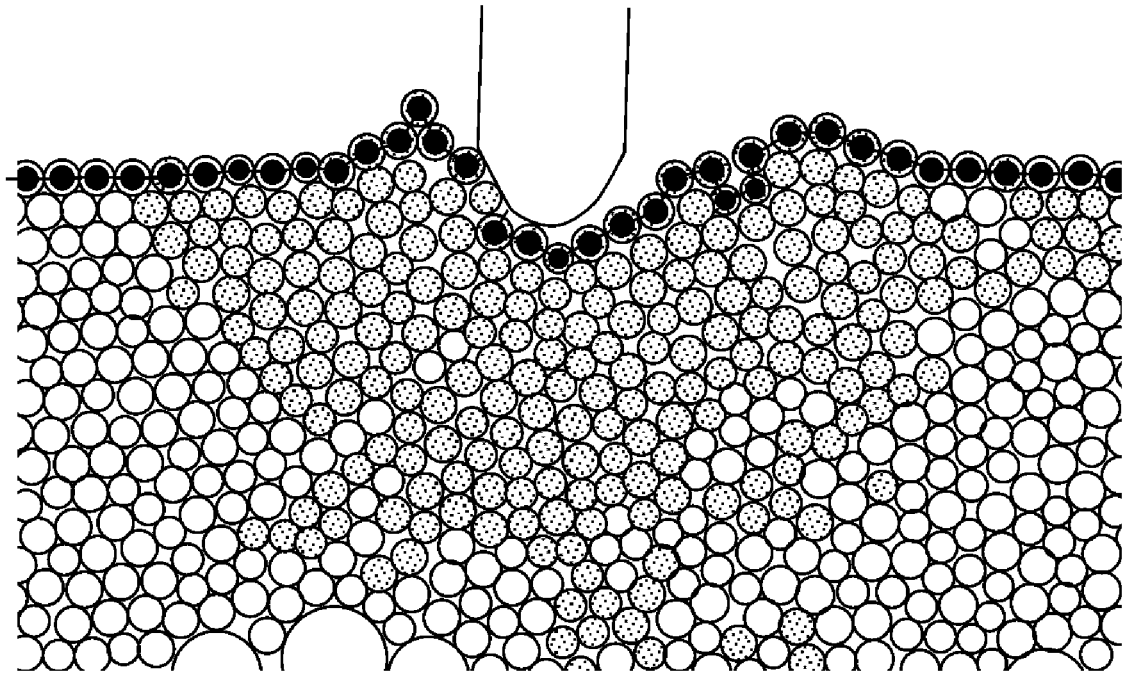
FIG. 8 is a PFC model of rock destruction at high pressure using a tooth configuration of a roller cone as is employed on a rolling cutter bit.

FIG. 8 of the drawings depicts a PFC model of a tooth of a roller cone of a rotating cutter bit indenting a rock formation with some degree of "skidding" of the tooth (as it would be mounted to or formed on the roller cone) that moves from right to left in the drawing figure, simulating the combined, well-known rotation and sliding motion of a tooth of a roller cone in an actual drilling operation as the bit is rotated and the cone rotates, under weight on bit. As with previous examples described above, the contiguous dark balls at the outer surface of the virtual rock formation represent the boundary on which confining pressure is applied. The "skidding" is evident from the build up of rock material to the left of the tooth. Behavior of virtual rock under impact of a cutting structure of a percussion bit may, likewise, be simulated.

CONCLUSIONS

DEM is a good tool for modeling rock cutting. Large strain and crack propagation are handled naturally. DEM materials exhibit a transition from shear localization to shear-enhanced compaction in virtual triaxial tests like real rocks do. Particle Flow Code gives good qualitative agreement between rock cutting tests and models of those tests.

Inelastic properties have a stronger influence on rock drillability than elastic properties. Inelastic parameters that characterize rock may be identified and used as analysis tools in DEM. Rock should be evaluated at higher strain levels than previously realized to identify new fundamental mechanical properties that govern drilling.

The area under the stress/strain curve may be a good parameter with which to quantify rock drillability, due to its correlation with specific energy. Thus, there are opportunities to use the area under the stress/strain curve to understand how to apply DEM at high pressure. It is believed that the stress difference at high strain may also be employed as a practically attainable measure that will correlate with rock cutting and rock drillability.

While the present invention has been described in terms of certain embodiments, those of ordinary skill in the art will recognize that it is not so limited, and that variations of these embodiments are encompassed by the present invention. Accordingly, the present invention is limited only by the scope of the claims which follow, and their legal equivalents.

The disclosure of each of the documents referenced in the foregoing specification is hereby incorporated in its entirety by reference herein.

What is claimed is:

1. A method of predicting performance of a cutting structure in a subterranean formation, the method comprising:

obtaining inelastic stress/strain characteristics of an actual rock material at a plurality of confining pressures greater than a hydrostatic pressure in excess of ambient pressure;

simulating a virtual rock material using discrete element modeling (DEM);

calibrating the virtual rock material using the obtained stress/strain characteristics to produce substantially the same inelastic stress/strain response over simulated confining pressures corresponding to at least some of the confining pressures greater than the hydrostatic pressure;

simulating movement of a virtual cutting structure engaging the virtual rock material under high pressure conditions confining rock detritus cut from the virtual rock material at one or more simulated confining pressures greater than a simulated hydrostatic pressure; and using at least one DEM-generated stress/strain curve of inelastic response of the virtual rock material to the simulated movement of the virtual cutting structure to predict the performance of an actual cutting structure.

2. The method of claim 1, further comprising using the at least one DEM-generated stress/strain curve to predict drilling efficiency.

3. The method of claim 1, wherein using DEM comprises using Particle Flow Code (PFC).

4. The method of claim 1, wherein the cutting structure comprises one of a fixed cutter, a cutting tooth on a roller cone, and a percussive cutting structure.

5. The method of claim 1, further comprising:

mathematically modeling at least two drill bit designs for use in a DEM environment;

simulating drilling through the virtual rock material with the at least two mathematically modeled drill bit designs under high pressure conditions confining rock detritus cut from the virtual rock material at one or more simulated pressures greater than a simulated confining hydrostatic pressure; and comparing apparent specific energy for the at least two drill bit designs using an area under DEM-generated stress/strain curves associated with the simulated drilling.

6. The method of claim 5, wherein DEM is effected using Particle Flow Code (PFC).

7. The method of claim 5, wherein the least two drill bit designs comprise at least two rotary drag bit designs, at least two rolling cutter bit designs, or at least two percussion bit designs.

8. The method of claim 1, further comprising;

selecting a plurality of confining pressures above at least one selected hydrostatic pressure;

selecting a cutting structure configuration;

conducting at least one test at each of the plurality of confining pressures using a cutting structure of the selected configuration to engage the actual rock material while measuring stress applied by the cutting structure to the actual rock material, and resulting inelastic strain in the actual rock material;

simulating engagement of the virtual rock material using a virtual cutting structure of the selected configuration and an applied virtual stress substantially the same as the stress applied by the cutting structure under each of the selected confining pressures of the plurality in the DEM environment, and modeling a resultant inelastic strain in the virtual rock material; and developing an equivalence of stress/strain behavior of the virtual rock material to the stress/strain behavior of the actual rock material for at least some of the selected plurality of confining pressures across at least an inelastic region of the stress/strain curve.

9. The method of claim 8, further comprising developing the equivalence over a sufficient range of the plurality of selected confining pressures to capture both strain softening and strain hardening of the virtual rock material.

10. The method of claim 1, wherein simulating movement of a virtual cutting structure engaging the virtual rock material further comprises:

engaging a boundary surface of the virtual rock material by applying stress using the virtual cutting structure in the DEM environment under the one or more simulated confining pressures; and modeling destruction of the virtual rock material using a predicted inelastic associated strain exhibited by the virtual rock material under the applied stress in the DEM environment.

11. The method of claim 10, wherein the virtual cutting structure comprises one of a fixed cutter, a tooth on a roller cone, and a percussive cutting structure.

12. The method of claim 10, further comprising employing a plurality of simulated confining pressures and repeating the engagement of the virtual rock material with the virtual cutting structure.

13. The method of claim 10, further comprising varying at least one parameter selected from at least one of a size, a shape, and an orientation of the virtual cutting structure, a force of engagement of the virtual rock material with the virtual cutting structure, a depth of engagement of the virtual rock material with the virtual cutting structure and a direction of engagement of the virtual rock material with the virtual cutting structure and repeating the engagement of the virtual rock material with the virtual cutting structure using the at least one varied parameter.

14. The method of claim 13, further comprising comparing determined behavior of the virtual rock material under the at least one varied parameter and changing at least one physical parameter of an actual drilling tool responsive to the comparison.

* * * * *